US005775660A

United States Patent [19]

Coope

[11] Patent Number: 5,775,660

[45] Date of Patent: Jul. 7, 1998

[54] CLAMP ASSEMBLY

[75] Inventor: Robert L. Coope, Phoenix, Ariz.

[73] Assignee: Stevens Engineering, Phoenix, Ariz.

[21] Appl. No.: 906,995

[22] Filed: Aug. 6, 1997

[51] Int. Cl.[6] ..... A44B 21/00; B65D 63/00

[52] U.S. Cl. ..... 248/505; 248/154; 24/68 CT; 59/86; 403/79

[58] Field of Search ..... 24/68 CT, 68 CD, 24/16 R; 248/500, 505, 154; 403/79; 59/86

[56] References Cited

U.S. PATENT DOCUMENTS

| | | | |
|---|---|---|---|
| 2,120,497 | 6/1938 | Heinrich | 24/68 CT |
| 2,259,880 | 10/1941 | Ehmann | 59/86 |
| 3,426,996 | 2/1969 | Broling | 24/68 CT |
| 3,601,864 | 8/1971 | Roberts | 24/68 CT |
| 4,592,686 | 6/1986 | Andrews | 248/500 |

*Primary Examiner*—Victor N. Sakran
*Attorney, Agent, or Firm*—Parsons & Goltry; Robert A. Parsons; Michael W. Goltry

[57] ABSTRACT

A clamp assembly including a flexible restraining element having a first end and a second end, the flexible restraining element receivable about an irregularly-shaped item carried upon a work surface, a brace for engaging the first end of the flexible restraining element to the work surface and a coupler for engaging the second end of the flexible restraining element to the work surface and for adjusting the flexible restraining element about the irregularly-shaped item for clamping the irregularly-shaped item to the work surface.

6 Claims, 3 Drawing Sheets

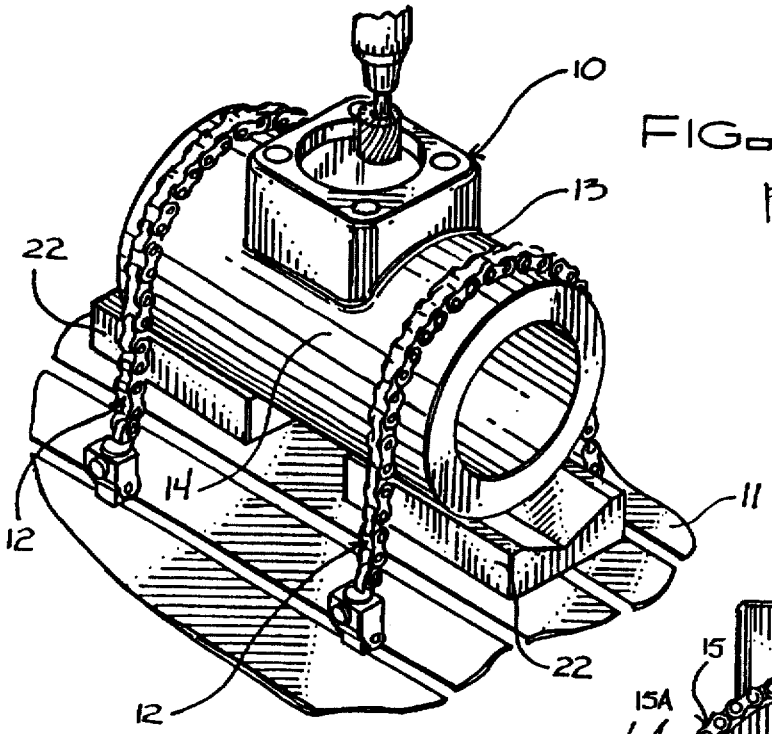
FIG. 1
prior art
FIG. 2
prior art
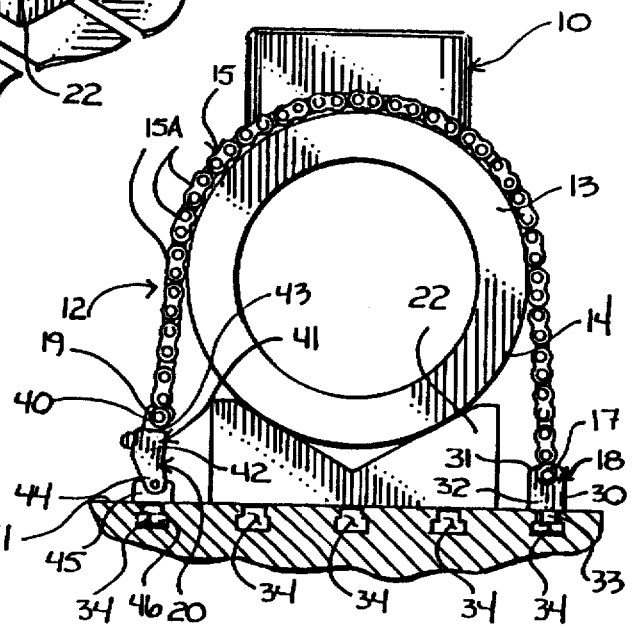
FIG. 3
prior art
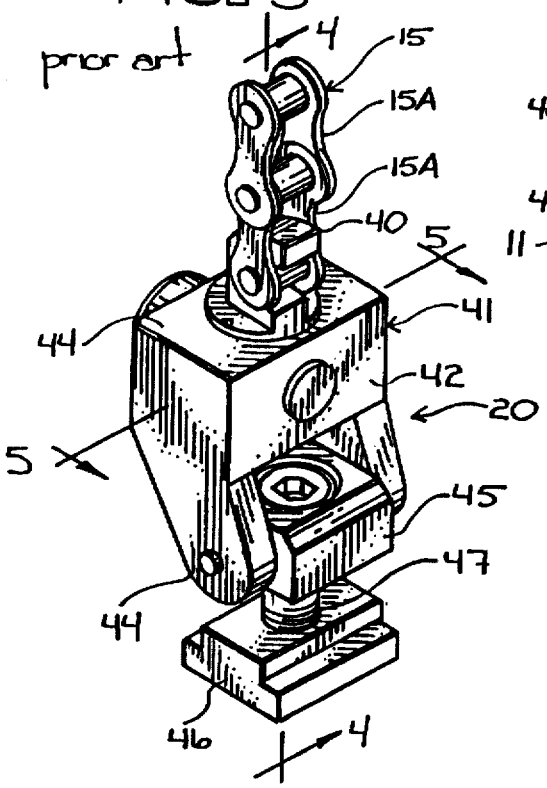

FIG. 8
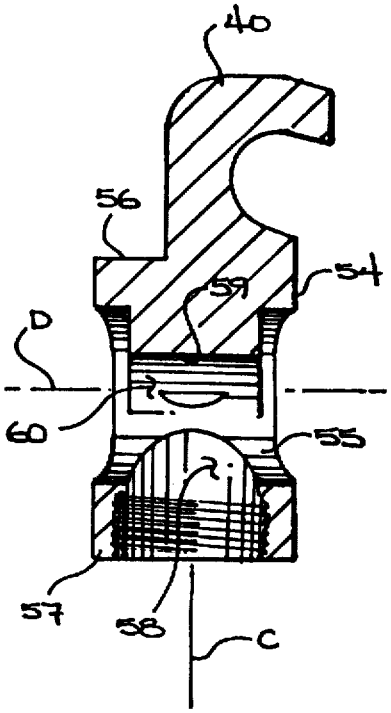
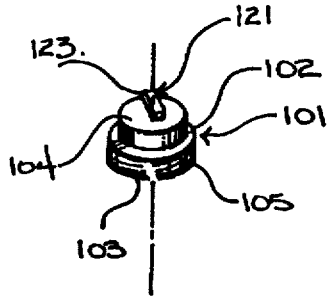
FIG. 7
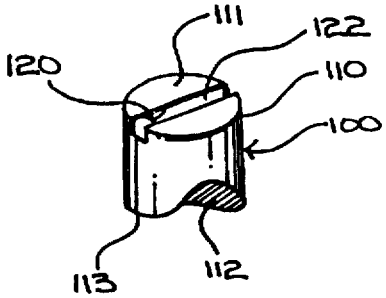
FIG. 6

CLAMP ASSEMBLY

BACKGROUND OF THE INVENTION

1. Field of the Invention

This invention relates generally to the field of clamps.

More particularly, this invention relates to clamps for clamping items to a work surface.

In a further and more specific aspect, the instant invention relates to a clamp assembly for clamping and immobilizing irregularly shaped items to a work surface.

2. Prior Art

A clamp is normally defined as any of various devices used to join, grip, support, or compress mechanical or structural part or for otherwise bracing objects or holding them together. Although the prior art is replete with clamps that may be used in various clamping applications, considerable effort has been focused in the construction of a clamp suitable for bracing or otherwise immobilizing irregular shaped objects to a work surface. In particular, those skilled in the art have found the efficient clamping or immobilization of substantially round or annular objects to a work surface significantly challenging. As a result, the lack of an efficient clamping mechanism to facilitate the bracing of large, awkward or irregularly shaped items such as round, oval and the other irregularly shaped items to a work surface necessitates certain new and useful improvements.

It would be highly advantageous, therefore, to remedy the foregoing and other deficiencies inherent in the prior art.

Accordingly, it is an object of the present invention to provide a clamp assembly for clamping or otherwise bracing irregularly shaped items to a work surface.

Another object of the present invention is to provide a clamp assembly that is easy to use.

And another object of the present invention is to provide a clamp assembly the is relatively easy to construct.

Still another object of the present invention is to provide a clamp assembly that is relatively inexpensive.

Yet another object of the instant invention is to provide a clamp assembly that is efficient and convenient.

SUMMARY OF THE INVENTION

Briefly, to achieve the desired objects of the instant invention in accordance with a preferred embodiment thereof, provided is a clamp assembly for clamping an irregularly-shaped item to a work surface and for immobilizing the irregularly-shaped item relative the work surface. Clamp assembly includes a flexible restraining element having a first end and a second end, the flexible restraining element receivable about an irregularly-shaped item carried upon a work surface. Further included is a brace for engaging the first end of the flexible restraining element to the work surface.

A coupler is also provided for engaging the second end of the flexible restraining element to the work surface in spaced-apart relation relative the first end of the flexible restraining element and for adjusting the flexible restraining element about the irregularly-shaped item for clamping the irregularly-shaped item to the work surface. The coupler includes a housing having a distal end engagable to the work surface, a proximal end, a first bore having a diameter and extending through the housing along a first axis, and a second bore having a diameter and extending through the housing along a second axis, the first axis and the second axis intersecting at a junction. The coupler further includes an adjustment member including a body having a diameter somewhat less than the diameter of the first bore of the housing, an upper end, a lower end, a blind bore extending inwardly into the body of the adjustment member from the lower end along a first axis and terminating with an endwall, and a bore extending through the body of the adjustment member along a second axis, the first axis of the blind bore and the second axis of the bore of the adjustment member intersecting at a junction, and an engagement element extending outwardly from the upper end of the body of the adjustment member for engaging the second end of the flexible restraining element. The adjustment member is receivable by the first bore of the housing for reciprocating movement along the first axis of the first bore with the lower end of the adjustment member directed toward the distal end of the housing, the engagement element extending outwardly from the proximal end of the housing with the second axis of the bore of the adjustment member being substantially common with the second axis of the second bore of the housing.

The coupler also includes a crank having an eccentric element receivable into and through the first bore of the housing and the bore of the coupler for rotation, a plug engagable to the lower end of the adjustment member and having an upper surface spaced from the endwall of the adjustment member, the upper surface of the plug and the endwall of the adjustment member cooperating together to define a medial portion of the bore of the adjustment member and a spacer carried by the upper surface of the plug. The Spacer further includes a recess for capturing portions of the eccentric element extending through the medial portion of the bore of the adjustment member, the spacer being of a size sufficient to cause the eccentric element to bear against the endwall of the adjustment member allowing a user to impart reciprocating movement to the adjustment member upon rotation of the crank in a predetermined direction to urge the adjustment member either inwardly toward the distal end of the housing to tighten the flexible retention member about the irregularly shaped item or outwardly toward the proximal end of the housing to loosen the flexible retention member from the irregularly shaped item.

The present invention further includes an engagement assembly including an engagement element carried by the spacer and a complemental engagement element carried by the plug, the engagement element being engagable with the complemental engagement element for inhibiting the spacer from migrating along the axis of the eccentric element. In a preferred embodiment, the engagement element includes a groove and the complemental engagement element includes a pin.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which:

FIG. 1 illustrates a perspective view of an irregularly shaped item clamped or otherwise braced to a work surface by virtue of a pair of prior art clamp assemblies;

FIG. 2 illustrates a front elevational view of the irregularly shaped item of FIG. 1 with one of the prior art clamp assemblies of FIG. 1 shown as it would appear engaged about the irregularly shaped item for clamping or otherwise bracing the irregularly shaped item to the work surface, the prior art clamp assembly including a flexible restraining element shown traversing the irregularly shaped item and having a first end engaged to the work surface by virtue of a brace and a second end coupled to the work surface by virtue of a coupler;

FIG. 3 illustrates an enlarged perspective view of the coupler of FIG. 2;

FIG. 6 illustrates a perspective view of a spacer constructed in accordance with a preferred embodiment of the present invention;

FIG. 7 illustrates a perspective view of a plug constructed in accordance with a preferred embodiment of the present invention; and FIG. 8 illustrates a sectional view taken along line 8—8 of an adjustment member of the coupler shown in FIG. 5.

DETAILED DESCRIPTION OF THE PREFERRED EMBODIMENT

Figure 4:
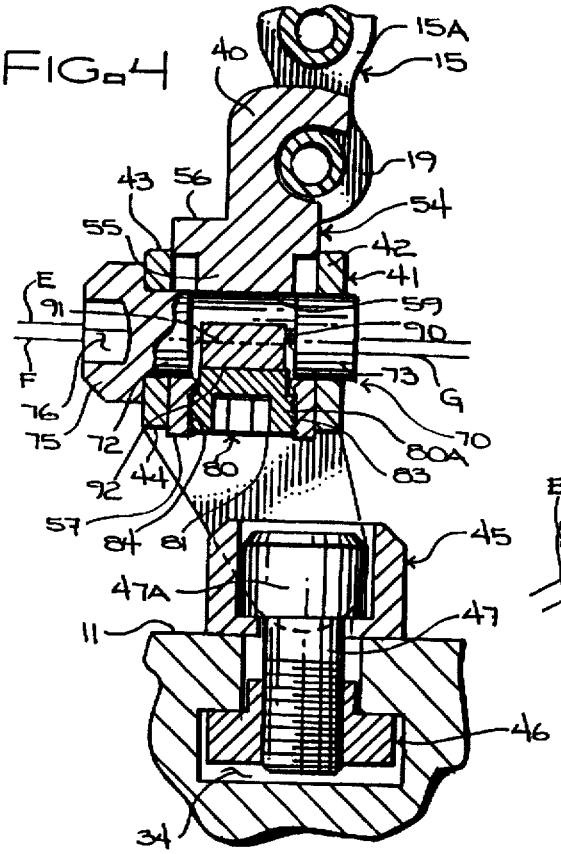
FIG. 4 illustrates a sectional view taken along line 4—4 of FIG. 3.

Turning now to the drawings, in which like reference characters indicate corresponding elements throughout the several views, attention is first directed to FIG. 1 illustrating a perspective view of an object or item 10 having an irregular shape clamped or otherwise braced to a work surface 11 by virtue of a pair of clamp assemblies, each being generally designated by the reference character 12. Clamp assembly 12, to be herein disclosed in combination with FIGS. 1–5, is a prior art apparatus that has been manufactured and sold by the Applicants of the present patent application for more than one year prior to the filing date of the present patent application. However, as it will be shown through the discussion of clamp assembly 12, certain inherent deficiencies in the efficient and exemplary operation thereof have necessitated certain new and useful novel improvements to be presented herein. In this regard, because clamp assembly 12 is prior art and well known to those having ordinary skill, the various structural and functional details of clamp assembly 12 will be discussed only to the extent sufficient to present the novel improvements.

As can be seen in FIG. 1, item 10 includes a generally cylindrical body 13 having a substantially cylindrical outer surface 14. Due to the cylindrical shape of body 13 of item 10, the ability to efficiently clamp or brace item 10, and other objects having similar irregular shapes such as round, oval or perhaps oblate, presents a challenge. However, with the advent of clamp assembly 12, two of which are shown in FIG. 1, this challenge has been greatly diminished.

With attention directed to FIG. 2 illustrating a front elevational view of item 10 of FIG. 1, one of the clamp assemblies 12 of FIG. 1 is shown as it would appear engaged about item 10 for bracing or otherwise immobilizing item 10 to work surface 11. Clamp assembly 12 includes a flexible restraining element 15 traversing outer surface 13 of item 10 and having a first end 17 engaged to work surface 11 by virtue of a brace 18 and a second end 19 coupled to work surface 11 by virtue of a coupler 20. In this specific example, flexible restraining element 15 is a chain of a conventional sort including a plurality of metal rings or links 15A connected or fitted into one another. Regarding FIG. 2, brace 18 includes a body 30 having an upper end 31 mounted to first end 17 of flexible restraining element 15 and a lower end 32 mounted to a race 33 receivable within one of a plurality of ways 34 formed into work surface 11. In this manner of construction, a user may insert race 33 within way 34 and then slidably move brace 18 within way 34 to a desired location along work surface 11. Consistent with the nature and scope of clamp assembly 12, although brace 18 is shown as a conventional manner of fixedly securing first end 17 of flexible restraining element 15 to work surface 11, first end 17 may otherwise be directly engaged with work surface or engaged with work surface 11 by virtue of any desired and suitable mechanical engagement mechanism.

With continuing reference to FIG. 2 and additional reference to FIG. 3 illustrating an enlarged perspective view of coupler 20 of FIG. 2, coupler 20 includes an engagement element 40 operative for engaging second end 19 of flexible restraining element and mounted with a housing generally designated at 41 for reciprocating adjustability or movability, further details of which will be discussed presently. Housing 41 is comprised of a body 42 having a proximal end 43 and a distal end 44 secured to a support member 45 coupled to a race 46 receivable within one of the plurality of ways 34 formed into work surface 11 in spaced relation relative brace 18. In this manner of construction, a user may insert race 46 within way 34 and then slidably move coupler 20 within race 34 to a desired location along work surface 11. Regarding FIG. 3, support member 45 is shown coupled to race 46 by virtue of a bolt 47, although other suitable mechanical engagement mechanisms may be used.

Figure 5:
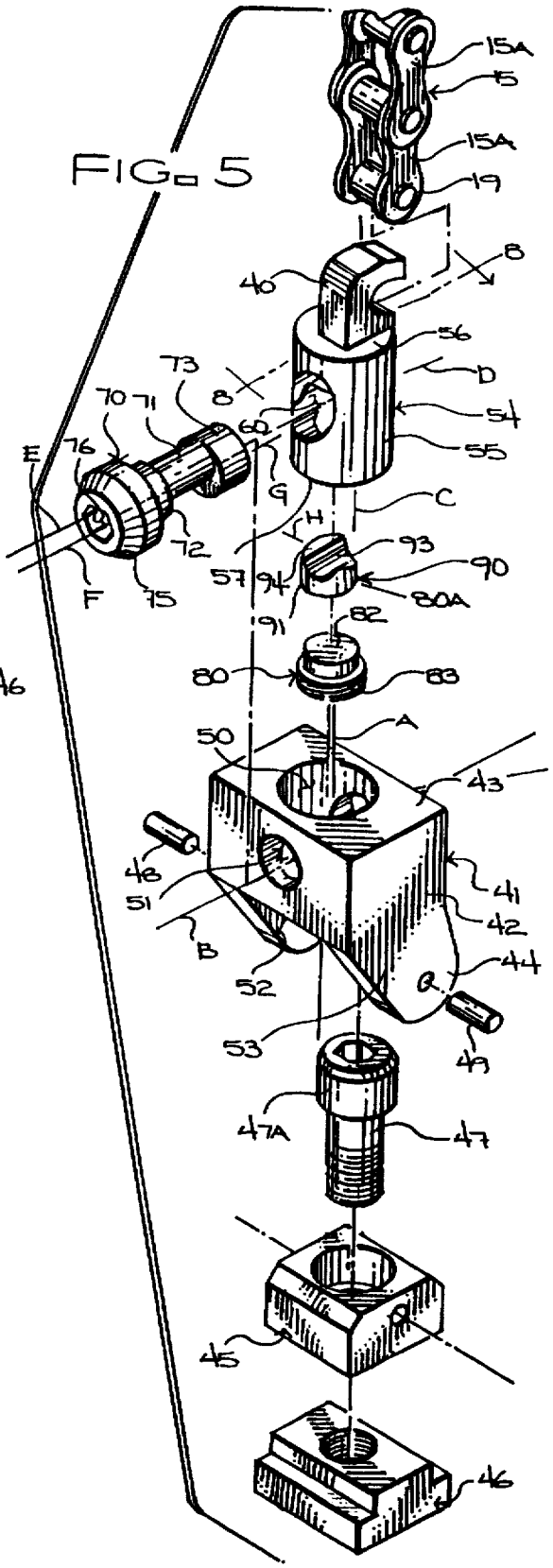
FIG. 5 illustrates an exploded perspective view of the prior art coupler of FIG. 3.

With attention directed to FIG. 5 illustrating an exploded perspective view of the prior art coupler 20, and to FIG. 4 illustrating a sectional view taken along line 4–4 of FIG. 3, the specific structural aspects thereof will now be discussed in relevant part to facilitate the subsequent disclosure of the improvements constituting the novel features of the present disclosure. In this regard, housing 41 of coupler 20 further includes a first bore 50 having a diameter and extending through body 42 of housing 41 along a first axis A from proximal end 43 and outwardly toward distal end 44. Further included is a second bore 51 having a diameter and extending through body 42 of housing 41 along a second axis B, the first axis A and the second axis B intersecting at a junction. Housing 41 also includes a pair of spaced apart brackets 52 and 53 extending downwardly from body 42 terminating and defining distal end 44. Distal end 44 is preferably, although not essentially, mounted for pivotal movement to support member 45 by virtue of pivot pins 48 and 49 each receivable through an aperture formed through each bracket 52 and 53, respectively, and receivable by apertures carried by support member 45 for facilitating pivotal coupling. Further included is an adjustment member 54, also shown in FIG. 8 illustrating a sectional view taken along line 8—8 of FIG. 5, including a body 55 having a diameter somewhat less than the diameter of first bore 50 of housing 41, an upper end 56, a lower end 57, a blind bore 58 (not shown in FIG. 5) extending inwardly into body 55 in a direction from lower end 57 along a first axis C and terminating with an endwall 59 (not shown in FIG. 5). Adjustment member 54 further includes a bore 60 extending therethrough along a second axis D, the first axis C of blind bore 58 and second axis D of bore 60 intersecting at a junction, and engagement element 40 extending outwardly from upper end 56 for engaging second end 19 of flexible restraining element 15.

Adjustment member 54 is receivable by first bore 50 of housing 41 for reciprocating movement along first axis A of first bore 50 with lower end 57 of adjustment member 54 directed toward distal end 44 of housing 41 and engagement element 40 extending outwardly from proximal end 43 of housing 41. In this manner of installation, first axis A of housing 41 and first axis C of adjustment member 54 will reside substantially co-axially, with the second axis B of housing 41 and the second axis D of adjustment member 54 also residing in a substantially co-axial orientation.

Upon installation of adjustment member 54 with housing 41 in foregoing manner, a crank 70 may be mounted with housing 41 and adjustment member 54. Crank 70 includes an eccentric element 71 defining an axis E, first and second cams 72 and 73 defining first and second substantially common axes F and G, respectively, different from axis E of eccentric element 71. First and second cams 72 and 73 are each carried by a respective end of the eccentric element in spaced apart relation and each having a diameter somewhat less than the diameter of second bore 51 of housing 41 and bore 60 of adjustment member 54. In this regard, crank 70 is receivable into and through second bore 51 of housing 41 and bore 60 of adjustment member 54 with the first and second cams 71 and 72 mounted for rotation within first bore 51 of housing 41 on either side of bore 60 of adjustment member 54. Cam 72 further includes a headed end 75 having an aperture 76 formed therein of a size sufficient to receive an appropriately sized Allen wrench (not shown) for allowing a user to accomplish rotation of crank 70, further details of which will be discussed as the detailed description ensues.

Coupler 20 further includes a plug 80 engagable to lower end 57 of adjustment member 54 and having a body 80A a lower surface 81, an upper surface 82 spaced from endwall 59 (shown best in FIG. 4) of adjustment member 54, upper surface 82 of plug 80 and endwall 59 of adjustment member 54 cooperating together to define a medial portion 60A (shown only in FIG. 4) of bore 60 of the adjustment member 54. Although a variety of suitable engagement mechanisms may be employed for engaging plug 80 to lower end 57 of adjustment member 54, plug 80 includes an element 83 of an engagement pair and lower end 57 of adjustment member 54 includes a complemental engagement element 84 (shown only in FIG. 4) of the engagement pair, engagement element 83 being detachably engagable to complemental engagement element 84. In this specific example, engagement element 83 includes a threaded engagement element and complemental engagement element 84 includes a complemental threaded element, the threaded element of plug 80 being detachably engagable to the complemental engagement element of adjustment member 54 upon rotation of plug in a predetermined direction in accordance with conventional practice to enclose lower end 57 of adjustment member 54 thereby enclosing blind bore 58.

Coupler 20 further includes a spacer 90 positioned within the medial portion 60A of bore 60 of adjustment member 54 carried by upper surface 82 of plug 80. Spacer 90 includes a body 91 having a lower surface 92 (shown only in FIG. 4) and a saddle or recess 93 formed through an upper surface 94 thereof sized for capturing or mating portions of eccentric element 71 extending through medial portion 60A of bore 60 of adjustment member 54. Spacer 90 is preferably constructed of a size sufficient to cause eccentric element 71 to bear against endwall 59 of adjustment member 54.

With coupler 20 mounted to work surface 11, flexible restraining element 15 placed about item 10 with first end 17 thereof engaged to work surface 11 via brace 18 or other equivalent means and second end 19 thereof engaged to engagement element 40, a user may rotate crank 70 in a predetermined direction such as by inserting the end of an Allen wrench into aperture 76 and then rotating crank 70 via the Allen wrench. With cams 72 and 73 mounted for stationary relative rotation within second bore 51 of housing, the eccentricity of eccentric element 71 relative cams 72 and 73 imparts a reciprocating stroke to eccentric element 71 as crank 70 is rotated. In this specific example, upon rotation of crank 70 the stroke of eccentric element 71 residing within recess 93 of spacer 90 forces spacer 90 to slide laterally upon upper surface 82 of plug 80 along axis H shown in FIG. 4, of which is substantially perpendicular to axis E of eccentric element 71. In this manner, the action of rotation of crank 70 introduces a downward force on spacer 90 causing adjustment member 54 to slide downward into first bore 50 of housing 41 to tighten flexible restraining element 15 about item 10. When the rotation of crank 70 moves slightly past 180 degrees, spacer 90 will contact portions of body 55 of adjustment member 54 defining blind bore 58 limiting rotation of crank 70 to slightly over 180 degrees and locking adjustment member in place for bracing or otherwise immobilizing item 10 to work surface 11. Although not essential, and with attention directed to FIG. 1, item 10 may be nested within one or more support blocks 22 for inhibiting item 10 from rolling upon work surface 11, although this is not essential. The foregoing operation may be reversed for introducing an upward force on endwall 59 causing adjustment member 54 to slide upward through first bore 50 of housing 41 toward proximal end 43 of housing 41 to loosen flexible restraining element 15 about item 10.

Regarding the foregoing prior art, the length of eccentric element 71 is somewhat longer than the length of recess 93 of spacer 90. As a result, spacer 90 is free to migrate along axis E of eccentric element 71 causing spacer 90 to contact and hang-up on corners formed by the intersection of bore 60 of adjustment member 54 and blind bore 58 of adjustment member 54 thereby interfering with the ability of adjustment member 54 to reciprocate in first bore 50 of housing and inhibiting the ability of a user to rotate crank 70 along the full stroke of crank 70. Unless the full stroke of crank 70 is achieved, spacer 90 will not move through the entire motion and the desired locking action will not occur.

To alleviate this problem, attention is directed to FIG. 6 illustrating a spacer 100 constructed in accordance with a preferred embodiment of the present invention and FIG. 7 illustrating a plug 101 constructed in accordance with a preferred embodiment of the present invention. Spacer 100 and plug 101 are substantially identical to spacer 90 and plug 80 discussed in combination with FIG. 4 and FIG. 5 are may be used with coupler 20 in the manner substantially identical with spacer 90 and plug 80 as previously discussed. In this regard, and like plug 80, plug 101 includes a body 102 having a lower surface 103, an upper surface 104 and an engagement element 105 operative for detachably engaging complemental engagement element 84 of adjustment member 54 in the manner previously described. Furthermore, and like spacer 90, spacer 100 includes a body 110 having a lower surface 111 positionable upon upper surface 104 of plug 101 and a saddle or recess 112 formed through an upper surface 113 thereof.

Regarding the novel features of the present invention, spacer 100 further includes an engagement element 120 carried by lower surface 111, and plug 101 further includes a complemental engagement element 121 carried by upper surface 104. Engagement element 120 and complemental engagement element 121 define an engagement pair, engagement element 120 being engagable to complemental engagement element 121 upon installation of spacer 100 upon upper surface 104 of plug consistent with the discussion of the prior art plug 80 and spacer 90. Engagement element 120 and complemental engagement element 121 cooperate to permit spacer 100 to move laterally as necessary during the rotation of crank 70 along axis H shown in FIG. 5, while preventing spacer from migrating along axis E of eccentric element 71 and interfering with the reciprocating movement of adjustment member 54 relative housing 41. In a preferred embodiment of the present invention, engagement element 120 includes a groove 122 and complemental engagement element includes a pin 123. However, and consistent with the nature and scope of the present invention, engagement element 120 and complemental engagement element 121 may include a race and a way or other suitable engagement pair operative for permitting spacer 100 to move laterally along axis H while preventing spacer 100 from migrating along axis E of eccentric element 71.

The present invention has been described above with reference to a preferred embodiment. However, those skilled in the art will recognize that changes and modifications may be made in the described embodiments without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A clamp assembly for clamping an irregularly-shaped item to a work surface and for immobilizing the irregularly-shaped item relative the work surface, said clamp assembly comprising:

a flexible restraining element having a first end and a second end, the flexible restraining element receivable about an irregularly-shaped item carried upon a work surface;

first means for engaging the first end of the flexible restraining element to the work surface; and a coupler for engaging the second end of the flexible restraining element to the work surface in spaced-apart relation relative the first end of the flexible restraining element and for adjusting the flexible restraining element about the irregularly-shaped item for clamping the irregularly-shaped item to the work surface, the coupler comprising, a housing including a distal end engagable to the work surface, a proximal end, a first bore having a diameter and extending through the housing along a first axis, and a second bore having a diameter and extending through the housing along a second axis, the first axis and the second axis intersecting at a junction, an adjustment member including a body having a diameter somewhat less than the diameter of the first bore of the housing, an upper end, a lower end, a blind bore extending inwardly into the body of the adjustment member from the lower end along a first axis and terminating with an endwall, and a bore extending through the body of the adjustment member along a second axis, the first axis of the blind bore and the second axis of the bore of the adjustment member intersecting at a junction, and an engagement element extending outwardly from the upper end of the body of the adjustment member for engaging the second end of the flexible restraining element, the adjustment member receivable by the first bore of the housing for reciprocating movement along the first axis of the first bore with the lower end of the adjustment member directed toward the distal end of the housing, the engagement element extending outwardly from the proximal end of the housing with the second axis of the bore of the adjustment member being substantially common with the second axis of the second bore of the housing, a crank having an eccentric element receivable into and through the first bore of the housing and the bore of the adjustment member for rotation, a plug engagable to the lower end of the adjustment member and having an upper surface spaced from the endwall of the adjustment member, the upper surface of the plug and the endwall of the adjustment member cooperating together to define a medial portion of the bore of the adjustment member, a spacer carried by the upper surface of the plug and having a recess for capturing portions of the eccentric element extending through the medial portion of the bore of the adjustment member, the spacer being of a size sufficient to cause the eccentric element to bear against the endwall of the adjustment member allowing a user to impart reciprocating movement to the adjustment member upon rotation of the crank in a predetermined direction to urge the adjustment member either inwardly toward the distal end of the housing to tighten the flexible retention member about the irregularly shaped item or outwardly toward the proximal end of the housing to loosen the flexible retention member from the irregularly shaped item, an engagement element carried by the spacer, and a complemental engagement element carried by the plug, the engagement element being engagable a with the complemental engagement element for inhibiting the spacer from migrating along the axis of the eccentric element.

2. The clamp assembly of claim 1, wherein said engagement element includes a groove.

3. The clamp assembly of claim 2, wherein said complemental engagement element includes a pin.

4. For use with an assembly of a type including a flexible restraining element having a first end and a second end, the flexible restraining element receivable about an irregularly-shaped item carried upon a work surface, first means for engaging the first end of the flexible restraining element to the work surface and a coupler for engaging the second end of the flexible restraining element to the work surface in spaced-apart relation relative the first end of the flexible restraining element and for adjusting the flexible restraining element about the irregularly-shaped item for clamping the irregularly-shaped item to the work surface, the coupler of a type having a housing including a distal end engagable to the work surface, a proximal end, a first bore having a diameter and extending through the housing along a first axis, and a second bore having a diameter and extending through the housing along a second axis, the first axis and the second axis intersecting at a junction, an adjustment member including a body having a diameter somewhat less than the diameter of the first bore of the housing, an upper end, a lower end, a blind bore extending inwardly into the body of the adjustment member from the lower end along a first axis and terminating with an endwall, and a bore extending through the body of the adjustment member along a second axis, the first axis of the blind bore and the second axis of the bore of the adjustment member intersecting at a junction, and an engagement element extending outwardly from the upper end of the body of the adjustment member for engaging the second end of the flexible restraining element, the adjustment member receivable by the first bore of the housing for reciprocating movement along the first axis of the first bore with the lower end of the adjustment member directed toward the distal end of the housing, the engagement element extending outwardly from the proximal end of the housing with the second axis of the bore of the adjustment member being substantially common with the second axis of the second bore of the housing, a crank having an eccentric element receivable into and through the first bore of the housing and the bore of the coupler for rotation, a plug engagable to the lower end of the adjustment member and having an upper surface spaced from the endwall of the adjustment member, the upper surface of the plug and the endwall of the adjustment member cooperating together to define a medial portion of the bore of the adjustment member, and a spacer carried by the upper surface of the plug and having a recess for capturing portions of the eccentric element extending through the medial portion of the bore of the adjustment member, the spacer being of a size sufficient to cause the eccentric element to bear against the endwall of the adjustment member allowing a user to impart reciprocating movement to the adjustment member upon rotation of the crank in a predetermined direction to urge the adjustment member either inwardly toward the distal end of the housing to tighten the flexible retention member about the irregularly shaped item or outwardly toward the proximal end of the housing to loosen the flexible retention member from the irregularly shaped item, an engagement assembly, comprising:

an engagement element carried by the spacer, and a complemental engagement element carried by the plug, the engagement element being engagable with the complemental engagement element for inhibiting the spacer from migrating along the axis of the eccentric element.

5. The engagement assembly of claim 4, wherein said engagement element includes a groove.

6. The engagement assembly of claim 5, wherein said complemental engagement element includes a pin.

* * * * *